United States Patent [19]

Thomas et al.

[11] Patent Number: 4,942,633

[45] Date of Patent: Jul. 24, 1990

[54] ADJUSTABLE BED

[76] Inventors: Henry A. Thomas, 6615 Garlinghouse La., Dallas, Tex. 75252; Larry J. McBride, 3409 Louis Dr., Plano, Tex. 75023

[21] Appl. No.: 398,165

[22] Filed: Aug. 23, 1989

[51] Int. Cl.[5] ..... A47C 19/00

[52] U.S. Cl. ..... 5/11; 5/62; 5/63; 5/310; 5/312

[58] Field of Search ..... 5/11, 62, 63, 64, 200 R, 5/200 C, 201, 202, 288, 289, 310, 312, 315 R, 316

[56] References Cited

U.S. PATENT DOCUMENTS

| | | | |
|---|---|---|---|
| 2,636,246 | 4/1953 | Quaka | 5/11 X |
| 2,826,765 | 3/1958 | Entwistle | 5/202 X |
| 2,880,448 | 4/1959 | Maguire | 5/11 |
| 3,305,876 | 2/1967 | Hutt | 5/11 |
| 3,713,181 | 1/1973 | Hougland | 5/201 |
| 3,824,638 | 7/1974 | Bogar Jr. | 5/202 X |
| 4,501,033 | 2/1985 | Kessel et al. | 5/200 R |
| 4,598,434 | 7/1986 | Mis | 5/312 X |

*Primary Examiner*—Michael F. Trettel

*Attorney, Agent, or Firm*—Browning, Bushman, Anderson & Brookhart

[57] ABSTRACT

An adjustable bed is provided within a substantially rectangular bed frame and a headboard secured to the bed frame. The plurality of adjustable caster assemblies are provided for affixing to a respective side rail of the bed frame, and the caster assemblies cooperate to allow both elevation of the bed frame and thus the mattress supported on the bed frame, and inclination of the bed frame and mattress. Accordingly, the elevation of the head of the bed can be raised or lowered with respect to the foot of the bed, and similarly the elevation of the foot of the bed can be easily adjusted with respect to the head of the bed. Each of the caster assemblies includes adjustment members secured to a side rail of the bed frame, and first and second legs pivotably connected to the adjustment member and pivotably connected to each other adjacent the roller.

19 Claims, 3 Drawing Sheets

ADJUSTABLE BED

BACKGROUND OF THE INVENTION

1. Field of the Invention

The present invention relates to an adjustable bed and, more particular, to a bed having an adjustable frame such that the height of the head and foot of the mattress can be easily and independently regulated without the necessity of powered equipment.

2. Description of the Background

Probably for as long as people have slept or reclined on furniture (hereinafter referred to as a bed), users have devised techniques for altering the bed to better accommodate their particular needs and/or wants. It is clear that U.S. patents to adjustable beds date back in excess of 100 years. U.S. Pat. No. 202,685 issued in 1878 discloses a "bed stead" which allowed angular adjustment of one portion of the upper planar canvas with respect to the position of another portion of the canvas. U.S. Pat. No. 327,699 issued in 1885 discloses a mechanism for adjusting the foot of a bed relative to its fixed elevation head.

Manufacturers of early versions of adjustable beds often employed the concept of a hand crank and gearing to adjust the position of the sleeping surface relative to the floor, and/or utilized a separate mattress frame apart from the bed frame. Both of these concepts are disclosed, for example, in U.S. Pat. No. 506,056, while U.S. Pat. Nos. 1,506,525 and 3,259,921 each disclose techniques for adjusting the head of the bed. U.S. Pat. No. 1,427,618 discloses a bed spring mounted for center pivotal movement, so that elevation of the head results in equal lowering of the foot of the bed.

Those skilled in the art have long appreciated that the public's acceptance and utilization of an adjustable bed is related to the cost of manufacturing the bed, the cost of maintaining the bed in an operational condition, and the reliability of the bed adjustment equipment. Substantially increased manufacturing cost are associated with providing a bed with one frame for the bed (comprising side rails and end rails), and a separate frame for the box spring and/or mattress. While limited adjustment of the bed is possible according to the teachings of U.S. Pat. Nos. 2,018,529, 2,527,111, 2,584,135, and 2,985,891, the complexity and cost of manufacturing beds according to those patents has certainly limited their acceptance in the marketplace. Most consumers do not envision their bed as being "adjustable" in height, except to the extent that nominal adjustment is achieved by the screw-type leveling pads threaded to the ends of the bed frame legs. Nevertheless, others continue to try to improve upon the concept of an adjustable bed having a separate bed frame and mattress frame, as evidenced by more recently issued U.S. Pat. Nos. 4,062,074 and 4,715,073.

Beds commonly employed by patients receiving medical treatment often include mechanisms for adjusting the bed. These "hospital-type" beds are, however, also generally considered complex, unattractive, and too expensive for use by individuals not requiring such medical attention. An adjustable hospital-type bed is disclosed in Canadian Patent No. 630,105, and U.S. Pat. Nos. 4,070,720 and 4,097,937 disclose hospital-type beds intended for hospital use and/or use at home by patients under the care of a physician. U.S. Pat. No. 3,305,876 discloses an adjustable bed intended for hospital and nursing facility use, and provides for vertical height adjustment but not independent adjustment of both the head and the foot of the bed.

Many prior art adjustable beds have functional limitations which have further limited there acceptance by the public. U.S. Pat. No. 3,761,970 discloses an adjustable bed carriage, although adjustment of both the head and the foot of the bed relative to the floor is not envisioned. U.S. Pat. No. 2,750,602 discloses a bed which allows for two levels of elevation, although again both head and foot adjustment is not disclosed. U.S. Pat. No. 3,802,002 teaches an adjustable bed with a hand crank mechanism for achieving vertical movement of the bed, although again vertical movement of the head of the bed relative to the foot of the bed is not envisioned. U.S. Pat. No. 2,939,157 discloses a bed frame with controlled movement cross rails.

Numerous other inventors have attempted to devise an adjustable bed which can be manufactured at a relatively low cost, does not distract from the appearance of the bed, and provides high flexibility to meet the desires of the consumer. In spite of such numerous attempts, inventors in recent years have continued to devise techniques for achieving adjustment of a bed. U.S. Pat. Nos. 4,118,811 and 4,354,287 each provide for some adjustment of a bed, but do not provide for independent adjustment of both the head and the foot of a bed. U.S. Pat. No. 4,101,990 teaches a mechanism for adjusting the height of the bed, but does not teach head and foot adjustment. U.S. Pat. No. 4,087,872 discloses a bed frame which includes an electrically powered device coupled to arms to adjust the height of the head and the foot of the bed independently, although the technique of moving the frame with respect to the stationary legs requires the use of special headboard and footboard posts, and accordingly has not satisified the desires of consumers.

In addition to the above-identified patents, various mechanisms have been devised for connecting the rails of a bed frame to a headboard and/or footboard. Exemplary of such mechanisms are U.S. Pat. Nos. 2,799,868, 3,188,664, 3,758,895, and 4,501,033. While the teachings of these patents provide mechanisms for achieving a mechanical connection between the headboard to the frame of the bed, they do not teach a mechanism for achieving truly vertical inclination of the headboard with respect to an inclined bed frame, so that the elevation of both the head and the foot of the bed can be easily controlled by the user while the headboard remains in a vertical plane.

The disadvantages of the prior art are overcome by the present invention, and improved techiques are hereinafter disclosed for manufacturing and using an adjustable bed which can be easily regulated by the user so that elevation of both the head and the foot of the bed can be separately controlled without complex mechanisms and/or expensive power driving devices. Moreover, the adjustable bed according to this invention includes the capability of having an inclined upper sleeping surface for a bed supported on a similarly inclined bed frame, while the headboard and/or footboard connected to the inclined bed frame remains within a vertical plane, and can be adjusted up and down within this vertical plane.

SUMMARY OF THE INVENTION

According to a preferred embodiment of the present invention, an adjustable bed is provided having a box spring and mattress which are supported within a rectangular-shaped frame of the bed. The bed frame comprises a pair of side rails and end rails, and is supported by a plurality of adjustable caster assemblies which allow for the incremental height adjustment of the bed frame and thus the mattress and box spring supported thereon. Incremental height adjustment for the mattress thus allows for variances in mattress height caused by the addition or removal of foam pads, such that the height of the bed can be adjusted so that standard sized bedspreads properly touch the floor on the sides of the bed.

The adjustable caster assemblies allow for the independent adjustment of the head of the bed and the foot of the bed. Accordingly, the head may be elevated higher than the foot for individuals with digestive problems. Simiarly, the bed may be easily adjusted for individuals who prefer that their feet be slightly above their head to overcome circulatory problems. Regardless of the position of the head of the bed with respect to the foot of the bed, an adjustable headboard bracket enables the headboard and/or footboard to remain vertical.

The adjustable caster assemblies of the present invention enable the user to provide a selected floor-to-frame clearance to allow storage of desired articles under the bed. The construction of the end rails and the use of double screw attachments to the side rails allows for the elimination of the center support for queen and king sized mattresses. Accordingly, the elimination of the center foot commonly used in prior art beds provides increased storage under the bed frame for the user.

It is an object of the present invention to provide an adjustable bed wherein the position of both the head and the foot of the bed can be independently controlled, so that both the elevation and the inclination of the sleeping surface of the mattress can be easily altered as desired by the user.

It is another object of the invention to provide an adjustable bed wherein manufacturing cost are minimized by utilizing the bed frame as a supporting structure for the mattress, wherein inclination of the mattress is possible while maintaining the headboard in a vertical plane.

It is a feature of the present invention to provide an adjustable bed which can easily be adjusted in height without the use of complex crank and gearing mechanisms, and without utilizing expensive power drive mechanisms.

It is a further feature of the invention that the height and inclination of the mattress of a bed can be incrementally controlled as a function of preselective positions of the adjustable caster assemblies.

Yet another feature of this invention is that an adjustable frame of a bed may be used with various types of headboards, and may further be used with or without a conventional footboard.

It is an advantage of the invention that the height of both the head of the bed and the foot of the bed can be selectively controlled over a range of from 4" or less than 14" or greater, thereby providing for versatile storage capability under the bed.

It is a further advantage of the present invention to provide a bed frame with double screw attachments connecting each of the end rails to a respective side rail, thereby making possible the elimination of the center support commonly used in prior art beds and thus further increasing storage under the bed frame.

These and further objects, features, and advantages of the present invention will become apparent from the following detailed description, wherein references made to the figures in the accompanying drawings.

BRIEF DESCRIPTIONS OF THE DRAWINGS

DETAILED DESCRIPTION OF PREFERRED EMBODIMENTS

Figure 1:
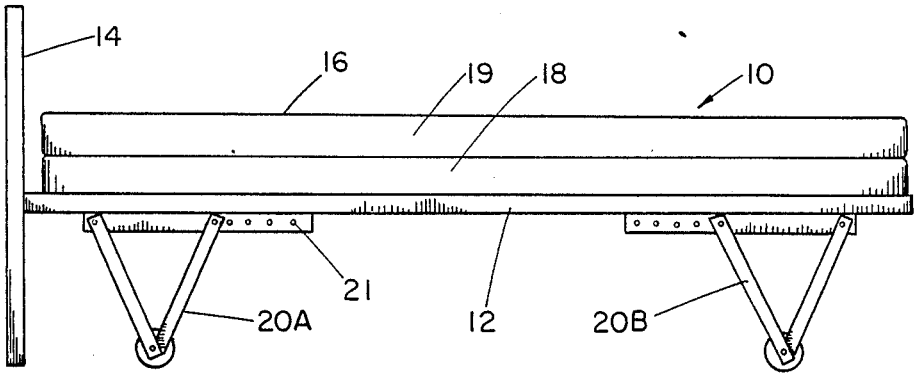
FIG. 1 is a simplied side view of an adjustable bed according to the present invention.

FIG. 1 depicts an adjustable bed 10 according to the present invention. The bed 10 comprises a generally rectangular frame 12, a headboard 14, box spring 18, and a mattress 19 having a substantially planar upper sleeping surface 16. The box spring is supported on the frame 12 in a conventional manner. The mattress 19 rests on the box spring and is thus indirectly supported by the frame 12, or may be directly supported by the frame 12 if a box spring is not utilized. As those skilled in the art appreciate, an number of pads of various thicknesses may be used above or below the mattress 19, and sheets and blankets are normally used to complete the fully made bed. A footboard (not shown in FIG. 1) may also be employed according to the concept of the present invention, and may be connected to the frame 12 in the same manner as that of the headboard 14.

FIG. 1 also depicts two adjustable caster assemblies 20A and 20B. Normally at least four such caster assemblies are required, with each such assembly being secured to the frame 12 adjacent to a respective one of its four corners. Each caster assembly 20 is shown in greater detail in FIG. 4, although it should be understood at this time that these caster assemblies allow for easy adjustment of the head and the foot of the frame 12, and thus the head and foot of the planar surface 16 of the bed. As shown in FIG. 1, the bed is level, i.e., the planar surface 16 is parallel to the planar floor on which the bed is positioned.

Figure 2:
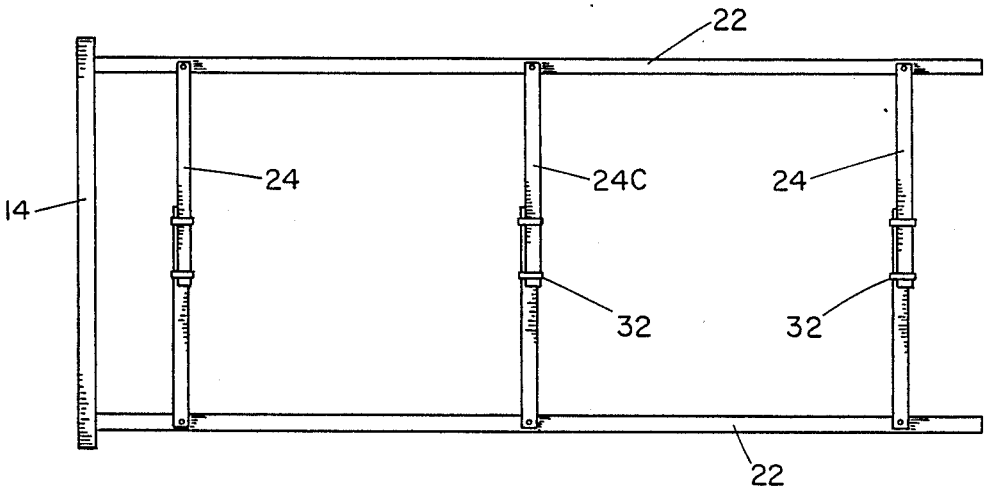
FIG. 2 is a top view of the bed shown in FIG. 1, but the box spring, and mattress removed for clarity.

FIG. 2 depicts the top view of the bed shown in FIG. 1, but with the mattress and box spring removed. The rectangular frame 12 comprises a pair of parallel angle iron side rails 22, with lateral movement of the box spring being prevented by the upwardly projecting side of each rail 22. Side rails 22 may be formed from any suitable structural elongate member, such as $1\frac{1}{2}'' \times 1\frac{1}{2}''$ angle iron.

The frame 12 as shown in FIG. 2 also comprises three cross rails 24, which consists of a pair of end rails and a center cross rail 24C. Each cross rail is a conventional two-part angle iron rail, and the overlap of the two-part rail ends allows for width adjustment for various sized box springs or mattresses, yet leaves sufficient spacing for a pair of securing assemblies 32 which prohibit unintended elongation of the cross rails. Each cross rail is preferably connected to a respective siderail in a manner which achieves the strength necessary to eliminate the "center foot" commonly provided in larger beds. By eliminating this center foot, storage under the bed is substantially increased. The center cross rail 24C is optional, and may be eliminated for certain beds, while utilization of the center cross rail and a conventional center foot, with a further optional addition of another caster assembly along each rail 22 and adjacent the center of the bed, renders the bed suitable for use with a water-filled mattress. If desired, the length of the cross rails 24 can be varied, so that the same bed as shown in FIG. 1 may be used for king or queen sized mattresses, or for twin or full sized mattresses.

Figure 3:
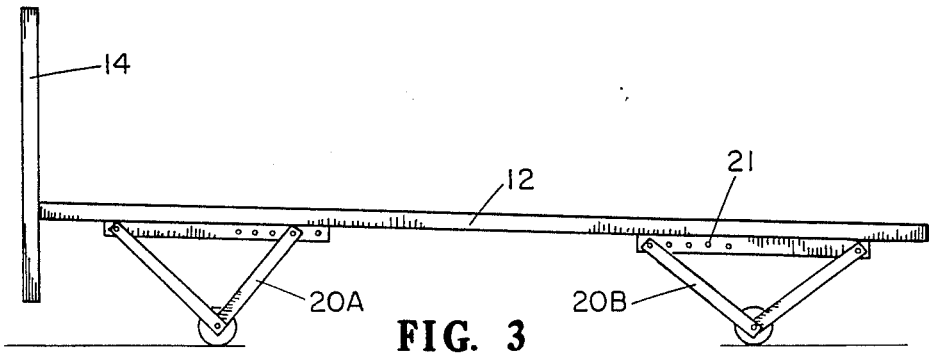
FIG. 3 is a side view of the bed frame shown in FIG. 2 adjusted at a selected inclination by the user, so that the head of the bed is slightly higher than the foot of the bed.

FIG. 3 depicts the bed frame as adjusted by the users so that the head of the bed is vertically above the foot of the bed. Accordingly, a plane passing uniformly through the frame 12 is angled downwardly as one moves from the head to the foot of the bed, although any line within that plane which is parallel to one of the cross braces 24 is also parallel to the floor. Certain physicians request that their patients sleep with his or her head slightly higher than his or her feet to alleviate digestive problems, and accordingly the bed as shown in FIG. 3 is able to easily achieve this goal. Raising of the head of the bed to its maximum extent and lowering the foot of the bed to its lowest level may, for example, enable a sick person to comfortably rest while still able to watch television positioned opposite the footboard with respect to the reclining individual.

It should be understood that caster assembly 20A and its associated head caster assembly on the opposite side rail may be lowered, and caster assembly 20B and its corresponding other foot caster assembly raised, so that the foot of the bed is higher than the head of the bed. This latter position of the bed may alleviate certain ciculatory problems the consumer is experiencing, or may achieve benefits generally recognized by medical and/or sleeping disorder experts. It is within the concept of the present invention that elevation of both the head of the frame 12 and the foot of the frame 12 may be selectively controlled within the range or from less than about 4" to more than about 14", which provides the desired flexibility of elevation for storage under the bed and achieves the desired inclination of the planar surface 16 of the bed.

Figure 4:
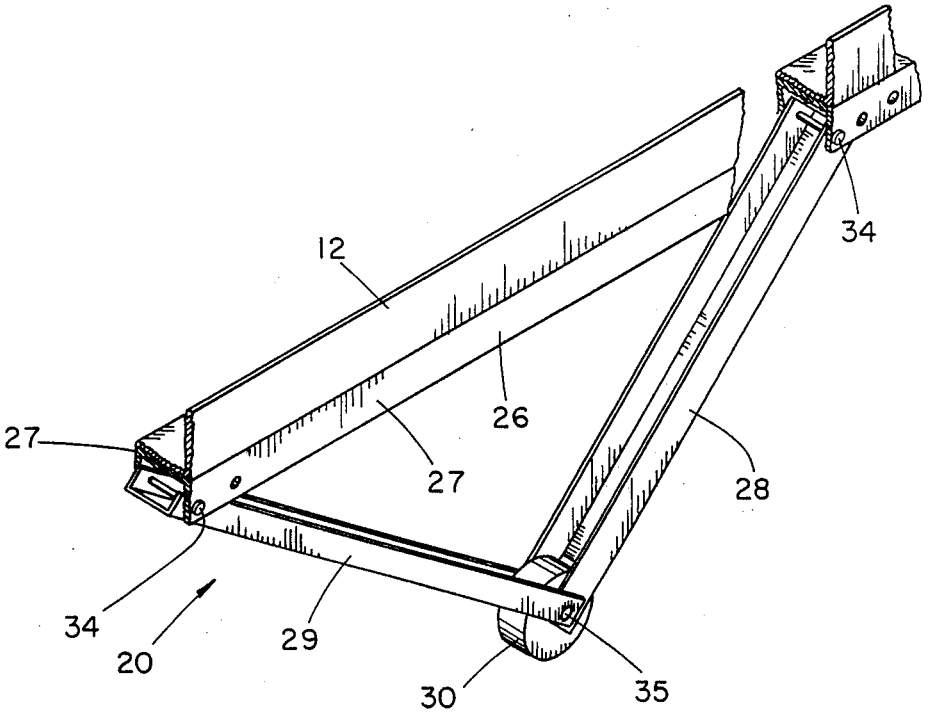
FIG. 4 is a pictorial view of one of the adjustable caster assemblies generally shown in FIGS. 1 and 3.

FIG. 4 depicts one of four adjustable caster assemblies 20. Each assembly 20 may be tack welded or otherwise secured in a conventional manner to the lower planar surface of a respective side rail 22. Assembly 20 comprises a $1'' \times 2'' \times 29\frac{1}{2}''$ channel member 26 which has a plurality (generally in excess of 12) holes 21 through each of the vertical ends 27 of the channel. A conventional pin 34 may be selectively positioned within one of the holes, and includes a securing device, such as a spring clasp, to temporarily hold the pin in place. Another $1'' \times 1\frac{3}{4}'' \times 15''$ channel 29 is pivotally connected to channel 27 as shown, while a $1'' \times 1\frac{1}{2}'' \times 15''$ channel 28 is simiarily pivotably connected to same channel 26 by another pin 34. A third pin 35 connects the free ends of the channels 28 and 29, and serves as an axis for wheel 30. The bottom (as compared to the sides) of the channels 28 and 29 may be cut away adjacent the pin 35 to accommodate the wheel or roller 30, which may optionally be provided with a conventional brake assembly (not shown). Similarly, the upper corners of the sides of each of the channels 28 and 29 may be marked to facilitate easy rotational movement of each channel 28, 29 about channel 26.

Those skilled in the art will now appreciate that the elevation of the head of the bed may be easily adjusted by removing one or both of the pins 34 for the assemblies 20 adjacent the head of the bed, and then replacing the pins 34 in another hole 21 which causes the head of the bed to be at its desired height. Both assemblies 20 adjacent the head of the bed will generally be at the same position (unless the floor is extremely uneven), and accordingly the holes 21 may be marked or otherwise designated with indicia or conventional markings to facilitate proper elevation by the user. The foot of the bed can similarly be elevated to its desired height by adjusting the two assemblies 20 adjacent the foot of the bed. If a pair of center adjustable caster assemblies are utilized, they could also be adjusted as a function of the selected height for the head and the foot of the bed.

Each of the adjustable caster assemblies 20 allow for incremental height adjustment of the head and foot of the frame 12 and thus the mattress in predetermined increments of, for example, 1". This adjustment will allow for variances in mattress height caused by the addition of new foam pads or the removal of old foam pads, thereby allowing a standard sized bedspread to properly touch the floor on all sides of the bed, but not be so long that the bedspread is folded over along the floor and appears to be "too big" for the bed.

As a modification of the assembly described above, the channels 28 and 29 may be identical in construction. In this case, the respective sides of each channel would offset slightly from each other so that, for example, channel 29 was positioned outward from channel 28 by approximately the width of one of the channel sides. In either case, one or more bushings may be provided on a side of the channel to compensate for the offset and/or keep the channels 28 and 29 properly positioned with respect to channel 26 and pivotable about pin 34. The pin 35 may be $\frac{1}{4}$ in diameter or greater to provide sufficient strength for the roller or caster 30, and the caster 30 may be fabricated from nylon to reduce the likelihood of marring the floor.

Figure 5:
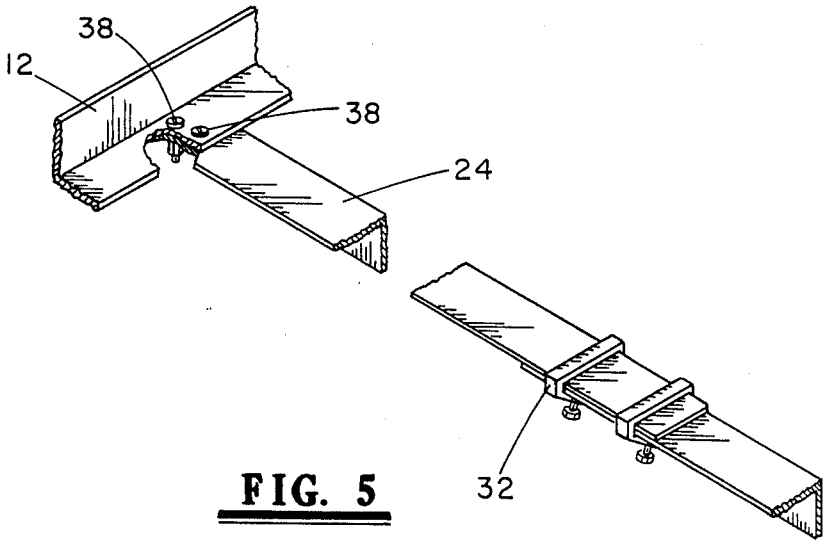
FIG. 5 is a pictorial view illustrating the connection between an end rail and a side rail, and further illustrating the connection of two elongate supports which form a single end rail.

FIG. 5 depicts one of the rails 24 secured to one of the side rails 22. A pair of offset flat head screw and nut assemblies 38 are provided to substantially increase structural rigidity between the rails 24 and 22 than is obtained by a single screw and nut assembly. The use of at least two securing assemblies between each end of each rail 24 and a respective side rail 22 achieves the desired strength so that the center foot commonly used in prior art beds may be eliminated. The width of the bed is controlled by loosening the clamp members 32 which secure the ends of two angle iron members together to form the rigid rail 24.

Figure 6:
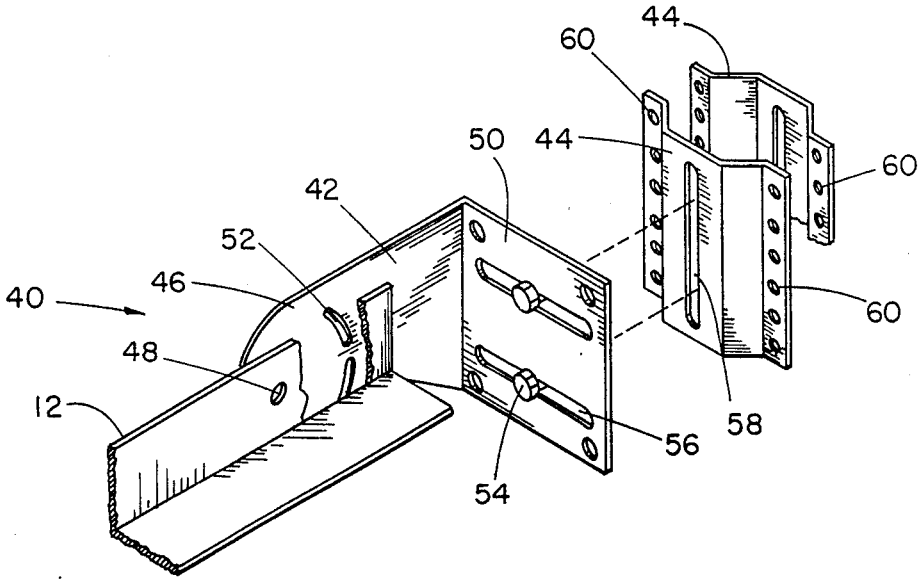
FIG. 6 is a pictoral view illustrating a suitable device for attaching the headboard to the side rail in order to achieve vertical positioning of the headboard while the bed frame is inclined.

FIG. 6 depicts a suitable mechanism for connecting each of the side rails 22 to a headboard or footboard. The attachment mechanism 40 comprises an angled plate 42 and a mounting plate 44. Side 46 of plate 42 includes one hole 48 for mating with a similar hole in the vertical side of rail 22, so that member 42 is pivotally connected to side rail 22 about the axis of a bolt (not shown) passing through the hole 48. A second bolt (also not shown in FIG. 6) selectively fixes the angular orientation of the plate 50 with respect to the side rail 22, and accordingly a pair of arcuate slots 52 are provided in side 46 for receiving a bolt which then passes through another aperture in the side rail 22. If the headboard is formed from wood, a pair of bolts 54 may be passed through the pair of elongate slots 56 in member 50, and then through a vertical slot 58 in the member 44. Mounting plate 44 may then be conventionally attached to the wood frame of the headboard by a plurality of screws (not shown) each passing through one of the side holes 60 in the mounting plate 44. In practice, each of the two mounting plates 44 may first be attached to the headboard, then angle bracket 42 may be connected to the bracket 44 by the bolt and nut assemblies 54. Thus the assembly as shown in FIG. 6 allows limited vertical adjustment of the headboard with respect to the frame of the bed, and most importantly allows the headboard to remain vertical, i.e., centered within a vertical plane, even though the frame 12 is angled in a manner as shown in FIG. 3.

Figure 7:
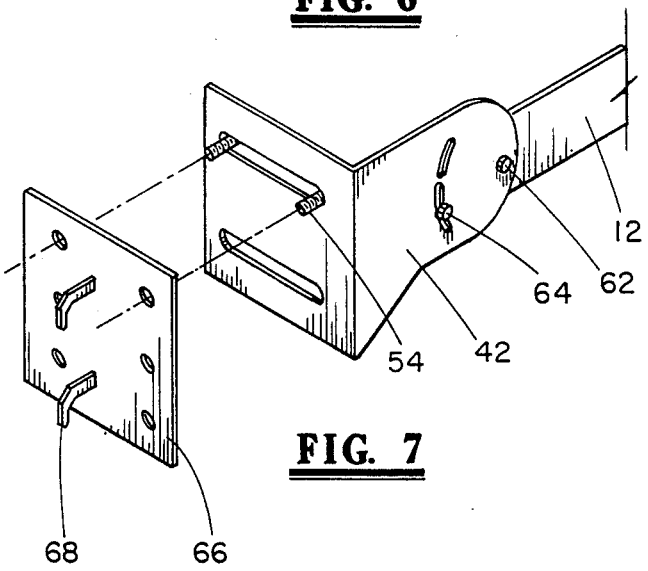
FIG. 7 is a pictoral view of an alternate device as shown in FIG. 6.

FIG. 7 depicts another embodiment for securing the headboard to the frame 12. The angled bracket 42 may be secured to each side rail of the frame 12 by a pair of bolts 62 and 64 in a manner as described above. Plate 66 includes a plurality of fingers 68 which allow vertical adjustment of the plate 66 along a standard slot in the headboard, and accordingly the bolts 54 can be used to interconnect the plates 66 and the mounting bracket 44 as shown. The mechanism as shown in FIG. 7 includes a plate 66 which is thus specifically adapted for a headboard or footboard with a sloted arrangement which is conventional for various types of headboards. Also, two plates 44 may be easily connected together in a face-to-face manner by conventional bolts passing through holes, so that slot 58 in the plate partially depicted in FIG. 6 is adjacent a post of the headboard. By using two sub plates 44 connected by conventional bolts, vertical adjustment of the headboard is possible since the top holes 60 in one plate may be aligned with the center holes in the mating plate. In this case, the second or mating plate 44 may then be connected to the headboard by bolts which fit in slot 58, as is conventional for some headboards and/or footboards.

With the exception of the roller members 30, all the components of the adjustable bed as shown in FIG. 2 and 3 preferrably fabricated from metallic goods. Most of the members can be easily formed from standard angle iron or channel members, while conventional metallic bolts and pins used to fixedly interconnect or pivotably interconnect the members as described above. By utilizing an adjustable channel 26 secured to the rectangular-shaped frame 12 of the bed, the frame of the bed itself need not be altered, and the adjustable caster assemblies as disclosed herein may therefore be added to or otherwise conventional frame of a bed. While the rollers may not be critical to the concept of the present invention, they are significant features of the invention in that the bed can be more easily moved, if necessary, to reposition the bed in the dwelling of the user and/or to temporarily move the bed to retrieve an object stored under the bed. As previously noted, the adjustable bed according to the present invention may include one of various types of headboards, and may also be used in conjunction with an optional footboard. The footboard could be attached to the foot end of the side rails in a manner substantially identical to that disclosed for attaching the headboard to the side rails.

An independant adjustable headboard attachment is provided for cooperating with the bed frame assembly to allow vertical positioning of the headboard such that its lowermost supporting surface remains in contact with the floor throughout the elevation or raising of the bed frame, and/or throughout the various inclination of the headboard. Accordingly, the adjustable headboard assembly provides for angular movement of the headboard such that it is always perpendicular to the floor regardless of inclination of the bed frame assembly.

Modifications will now be apparent to those skilled in art, and those modifications are contemplated by and with the scope of the present invention. For example, the metallic members of the adjustable bed frame according to the present invention could conventionally be painted or otherwise coated to achieve the desired surface finish and appearance. Although the elongate metallic members of the adjustable bed may be fabricated from relatively low costs structural iron, those same members can be fabricated from more visually attractive products, such as stainless steel or steel coated with a brass finish. Although the specific attachment means disclosed in this application for securing various members together preferred, there is other types of attachment means which are envisioned for simiarly securing these members together to achieve these same affect.

Using further modifications the invention should be apparent from the foregoing description, and are considered within the concept of the present invention. Moreover, it should be understood that the embodiments described above and illustrated in the accompanying drawings are provided by way of illustration only, and the invention is not necessarily limited to the embodiments described. Alternate embodiments and operating procedures representing modifications from the embodiments described herein thus can be made without departing from the spirit of the invention.

What is claimed is:

1. An adjustable bed including a substantially rectangular bed frame for supporting a mattress and having a head end and a foot end, the adjustable bed further comprising:

the bed frame including first and second substantially parallel side rails, a head cross rail interconnecting the first and second side rails and positioned generally adjacent the head end of the bed frame, and a foot cross rail interconnecting the first and second side rails and positioned generally adjacent the foot end of the bed frame; and first, second, third and fourth adjustable caster assemblies each affixed to a respective side rail adjacent a respective corner of the substantially rectangular bed frame, each of the adjustable caster assemblies including:

(a) a metallic adjustment channel secured to a respective side rail, (b) a first metallic leg formed from a first channel having a substantially U-shaped cross-sectional configuration and pivotably connected at its upper end to the adjustment channel at a first location, (c) a second metallic leg formed from a second channel having a substantially U-shaped cross-sectional configuration and pivotably connected at its upper end to the adjustment channel at a second location, (d) a pivot mechanism for pivotably interconnecting the lower end of the first and second metallic legs, and (e) adjustment means along the adjustment channel for varying the location for at least one of the first or second metallic legs with respect to the adjustment channel, such that the elevation and inclination of the bed frame may be adjusted by the first, second, third, fourth adjustable caster assemblies.

2. An adjustable bed as defined in claim 1, further comprising:

a roller rotatable about the pivot mechanism of each of the first, second, third and fourth adjustable caster assemblies for facilitating movement of the bed.

3. An adjustable bed as defined in claim 1, wherein in each of the first, second, third and fourth adjustable caster assemblies further comprises;

a plurality of through ports; and a pair of pins associated with at least two of the through ports each for pivotably interconnecting the adjustment means with a respective one of the first or second metallic legs.

4. An adjustable bed as defined in claim 1, further comprising:

first and second spaced securing means for fixedly interconnecting each end of each of the head cross rail and foot cross rail to a respective one of the side rails, such that pivotable movement of each of the cross rails with respect to the side rails is prohibited.

5. An adjustable bed as defined in claim 1, wherein the length of the first metallic channel is substantially identical to the length of the second metallic channel.

6. An adjustable bed as defined in claim 1, further comprising:

attachment means for interconnecting the head end of each of the side rails to a headboard, the attachment means including a first member pivotably connected to the side rail, a second member for secured engagement with the headboard, locking means for fixing the pivotable orientation of the first member with respect to the side rail, and fastener means for interconnecting the first and second members, such that the headboard lies substantially within a vertical plane while the side rail attached to the headboard is inclined with respect to the horizontal surface perpendicular to the vertical plane.

7. An adjustable bed as defined in claim 6, wherein the first member of the attachment means is an angled member having a first substantially planar portion including a through aperture and an arcuate slot, and having a second substantially planar portion secured to the first portion and fixed normally with respect thereto.

8. An adjustable bed including a bed frame having a head end and a foot end, a mattress supported on the bed frame having a substantially planar upper reclining surface, and a headboard secured to the head end of the bed frame, the adjustable bed further comprising:

the bed frame including first and second side rails, a head cross rail interconnecting the first and second side rails and positioned generally adjacent the head end of the bed frame, and a foot cross rail interconnecting the first and second side rails and positioned generally adjacent the foot end of the bed frame; and a plurality of adjustable caster assemblies each affixed to the bed frame, each of the adjustable caster assemblies including:

(a) an adjustment channel secured to a respective side rail, (b) a first leg pivotably connected at its upper end to the adjustment channel at a first location, (c) a second leg pivotably connected at its upper end to the adjustment channel at a second location, (d) a pivot mechanism for pivotably interconnecting the lower end of the first and second legs, and (e) adjustment means along the adjustment channel for varying the location for at least one of the first or second legs with respect to the adjustment channel, such that the elevation and inclination of the substantially planar reclining surface may be adjusted by the adjustable caster assemblies;

a roller rotatable about the pivot mechanism of each of the plurality of adjustable caster assemblies for facilitating movement of the bed; and attachment means for interconnecting the head end of each of the side rails to the headboard, the attachment means including a first member pivotably connected to the side rail, a second member for secured engagement with the headboard, locking means for fixing the pivotable orientation of the first member with respect to the side rail, and fastener means for interconnecting the first and second members, such that the headboard lies substantially within a vertical plane while the side rail attached to the headboard is inclined with respect to the horizontal surface perpendicular to the vertical plane.

9. An adjustable bed as defined in claim 8, wherein the first member of the attachment means is an angled member having a first substantially planar portion including a through aperture and an arcuate slot, and having a second substantially planar portion secured to the first portion and fixed normally with respect thereto.

10. An adjustable bed as defined in claim 8, further comprising:

first and second spaced securing means for fixedly interconnecting each end of each of the head cross rail and foot cross rail to a respective one of the side rails, such that pivotable movement of each of the cross rails with respect to the side rails is prohibited.

11. An adjustable bed as defined in claim 8, wherein each of the first and second legs is formed from a channel having a substantially U-shaped cross-sectional configuration.

12. An adjustable bed as defined in claim 11, wherein the length of the first channel is substantially identical to the length of the second channel.

13. An adjustable bed as defined in claim 8, wherein in each of the plurality of adjustable caster assemblies comprises;

a plurality of through ports; and a pair of pins associated with at least two of the through ports each for pivotably interconnecting the adjustment means with a respective one of the first or second legs.

14. An adjustable bed including a bed frame for supporting a mattress and having a head end and a foot end, and a headboard secured to the head end of the bed frame, the adjustable bed further comprising:

the bed frame including first and second side rails, a head cross rail interconnecting the first and second side rails and positioned generally adjacent the head end of the bed frame, and a foot cross rail interconnecting the first and second side rails and positioned generally adjacent the foot end of the bed frame; and a plurality of adjustable frame support assemblies each affixed to the bed frame for independently varying the height of the head end of the bed frame with respect to the foot end of the bed frame; and attachment means for interconnecting the head end of the bed frame to the headboard, the attachment means including a first member pivotably connected to the bed frame, a second member for secured engagement with the headboard, locking means for fixing the pivotable orientation of the first member with respect to the bed frame and fastener means for interconnecting the first and second members, such that the headboard lies substantially within a vertical plane while the side rail attached to the headboard is inclined with respect to the horizontal surface perpendicular to the vertical plane.

15. An adjustable bed as defined in claim 14, further comprising:

vertical adjustment means for cooperating with the attachment means to vary the vertical position of the bed frame with respect to the headboard, such that a lowermost supporting end of the headboard is within a plane defined by the lowermost supporting ends of the plurality of adjustable frame support assemblies.

16. An adjustable bed as defined in claim 15, wherein the vertical adjustment means comprises a bolt, a first plate having a through aperture for receiving the bolt, and a second plate having a plurality of spaced holes each for receiving the bolt, such that the elevation of the second plate with respect to the first plate is adjustable by positioning the bolt in a selected hole in the second plate.

17. An adjustable bed as defined in claim 14, wherein the first member of the attachment means is an angled member having a first substantially planar portion including a through aperture and an arcuate slot, and having a second substantially planar portion secured to the first portion and fixed normally with respect thereto.

18. An adjustable bed as defined in claim 14, further comprising:

first and second spaced securing means for fixedly interconnecting each end of each of the head cross rail and foot cross rail to a respective one of the side rails, such that pivotable movement of each of the cross rails with respect to the side rails is prohibited.

19. An adjustable bed as defined in claim 14, wherein each of the first and second legs is formed from a channel having a substantially U-shaped cross-sectional configuration.

* * * * *